US006681713B2

(12) United States Patent
Scott et al.

(10) Patent No.: US 6,681,713 B2
(45) Date of Patent: Jan. 27, 2004

(54) COMBINATION ENGINE COMPARTMENT COVER AND PRIVACY ENCLOSURE

(75) Inventors: Jerry L. Scott, Elkhart, IN (US); Jeremiah S. Warfel, Elkhart, IN (US); Bradley R. Fishburn, Nappanee, IN (US); Joseph L. Engelhaupt, Warsaw, IN (US)

(73) Assignee: Bennington Marine, LLC, Elkhart, IN (US)

( * ) Notice: Subject to any disclaimer, the term of this patent is extended or adjusted under 35 U.S.C. 154(b) by 0 days.

(21) Appl. No.: 10/293,460

(22) Filed: Nov. 13, 2002

(65) Prior Publication Data

US 2003/0127034 A1 Jul. 10, 2003

Related U.S. Application Data

(60) Provisional application No. 60/345,439, filed on Jan. 4, 2002, and provisional application No. 60/351,538, filed on Jan. 25, 2002.

(51) Int. Cl.[7] ..... B63B 17/00
(52) U.S. Cl. ..... 114/361; 114/364
(58) Field of Search ..... 114/343, 361, 114/363, 364

(56) References Cited

U.S. PATENT DOCUMENTS 4,883,016 A 11/1989 Larson
5,029,348 A 7/1991 Boren
5,862,540 A 1/1999 Chuan
6,263,825 B1 * 7/2001 Davidson ..... 114/343
6,302,053 B1 10/2001 Tomczak et al.
2002/0195041 A1 * 12/2002 Kalhok et al. ..... 114/361

OTHER PUBLICATIONS

Catalog, "Princecraft: Pontoons & Deck Boats", 1995–1996, 24 pages.

Catalog, "Kayot: Deck Style Baots Pontoons", 1994, 3 pages.

* cited by examiner

*Primary Examiner*—Stephen Avila
(74) *Attorney, Agent, or Firm*—Baker & Daniels

(57) ABSTRACT

A combination engine compartment cover and privacy enclosure includes a frame member, which is rotatable about a pivot adjacent to an engine compartment access through a deck of a pontoon boat. The entire enclosure can rotate to a position to access the opening, or the enclosure can be used as a privacy enclosure. A top cover of the unit is also rotatable relative to the frame and has a support bracket attached to a back of the top cover, where the bracket is rotatable to an upright position, where a privacy curtain may be assembled around the enclosure by way of snap members.

26 Claims, 12 Drawing Sheets

COMBINATION ENGINE COMPARTMENT COVER AND PRIVACY ENCLOSURE

BACKGROUND OF THE INVENTION

This application claims the benefit of U.S. Provisional Patent Application Ser. No. 60/345,439 filed Jan. 4, 2002, and U.S. Provisional Patent Application Ser. No. 60/351,538 filed Jan. 25, 2002, the complete disclosure of which is hereby expressly incorporated by reference.

The invention is directed to privacy enclosures for marinecraft, and in particular, for pontoon boats.

It is common in the pleasure craft industry, particularly in the pontoon boat industry, to include a privacy enclosure. The privacy enclosure can be raised to a position providing an enclosed area for a user to change into or out of a swimsuit during excursions. In some embodiments of privacy enclosures, lavatory facilities are also provided. While it is desirable to provide as many amenities as are possible, it is also of particular interest to not dedicate usable space on the pontoon deck area to lavatories, in order that the deck area on the pontoon boat is maximized. See, for example U.S. Pat. Nos. 4,883,016; 5,029,348; and 6,302,053. U.S. Pat. Nos. 4,883,016 and 5,029,348 both show a privacy enclosure which can be raised vertically; however, both references require substantial dedicated space simply for the privacy enclosure. U.S. Pat. No. 6,302,053, however, shows a privacy region which is stored on the rear side of a rotatable seat. However, in this application, the deck space beneath the seat is readily available for the privacy enclosure. It is desirable to have a privacy enclosure assembly, where decking space is not readily available, to even further maximize deck space.

SUMMARY OF THE INVENTION

The objects of the invention have been accomplished by providing a pontoon boat, comprising a hull portion comprised of a deck portion, a plurality of elongate pontoons positioned below the deck portion, the hull portion further comprising an engine compartment positioned adjacent an end of the of the hull portion, and at least partially below the deck portion, defining an engine compartment opening through the portion. An inboard-outboard engine is positioned within the engine compartment with a drive portion extending outwardly and rearwardly of the hull portion for propelling the pontoon boat. An engine compartment cover assembly substantially surrounds the engine compartment opening, the engine compartment cover assembly being pivotally mounted to the pontoon boat at a position adjacent to an edge of the engine compartment. The engine compartment cover assembly comprises upstanding side walls and end walls, the end walls and side walls defining a frame member which surrounds the engine compartment. The engine compartment cover assembly further comprises a raised floor section attached to the frame member, and a top cover portion which is pivotally mounted to the frame member, the top cover portion has a privacy enclosure assembly attached to an underside thereof, movable between stowed and upright positions and which includes a privacy curtain which drapes downwardly in the upright position to define the privacy enclosure.

In the preferred embodiment of the invention, the frame member includes a door allowing entry therethrough and access to the raised floor. Preferably, the privacy enclosure assembly includes a curtain frame which is pivotally mounted to the top cover portion. The engine compartment cover assembly and the top cover portion are pivotally movable about horizontal and parallel axes. The top cover portion has a locking latch for lockably latching the top cover portion to the frame member. The frame member has first spring means for holding the frame member in an upright position, which are preferably comprised of gas assisted shocks. The top cover portion has second spring means to hold the top cover portion in an upright position, which are preferably gas assisted shocks. The curtain frame has third spring means to hold the curtain frame in an upright position, which are preferably comprised of gas assisted shocks.

Also in the preferred embodiment of the invention, the pontoon boat frame has an open end wall and also further comprises a lounge seat pivotally mounted to the deck portion from a front edge thereof, and which partially overlies the engine compartment opening. When the lounge seat and the engine compartment cover assembly are positioned against the deck, the lounge seat and the engine compartment cover assembly abut to enclose the engine compartment, and when the lounge seat and the engine compartment cover assembly are pivoted open the engine compartment is accessible.

Also preferably, the lower edge of the privacy curtain is attachable to the end walls and side walls to define the privacy enclosure.

In another aspect of the invention, a combination engine compartment cover and privacy enclosure assembly is provided, for positioning over an engine compartment of marine craft, where the engine compartment defines an opening through the deck of the marine craft for access to an engine. The assembly comprises a frame member comprised of side walls and end walls which upstand to at least partially surround the opening, the frame member being pivotally connectable to the deck of the marine craft, for pivotal movement between a first closed position where the frame member abuts the deck, and a pivotally raised position with the opening accessible. A raised floor member is attached to the frame member and extends substantially between the end walls and side walls. A top cover member is pivotally attached to the frame member at an upper edge of one of the end or side walls. A privacy enclosure assembly is attached to an underside thereof, movable between stowed and upright positions and which includes a privacy curtain which drapes downwardly in the upright position to define the privacy enclosure.

In the preferred embodiment, the frame member includes a door allowing entry therethrough and access to the raised floor. Also preferably, the privacy enclosure assembly comprises support arms pivotally attached to an underside of the top cover. The top cover and the support arms are pivotal to positions substantially vertical. The privacy enclosure assembly further comprises a privacy curtain support member attached to ends of the support arm, opposite the pivoted ends. The top cover pivots about a rear edge thereof, and the support arms pivot about a position adjacent a front edge of the top cover, whereby when the top cover and the support arms are pivoted into the open position, the privacy curtain support member is raised above the deck to a height substantially equal to the additive length of the top cover and the support arms. The privacy curtain attaches to the end walls and the side walls to define-the privacy enclosure, and preferably by way of snap members. Preferably, the privacy curtain support member is rectangular, and the privacy curtain, when attached to the end walls and the side walls, defines a substantially truncated pyramidal shape.

The assembly frame has an open front end wall and further comprises a lounge seat for pivotally mounting to the deck portion from a front edge thereof, and for partially overlying the engine compartment opening, such that when the lounge seat and combination engine compartment cover and privacy enclosure assembly are positioned against the deck, the lounge seat and the engine compartment cover assembly abut to enclose the engine compartment, and such that when the lounge seat and the engine compartment cover assembly are pivoted open the engine compartment is accessible.

DETAILED DESCRIPTION OF THE PREFERRED EMBODIMENT

Figure 1:
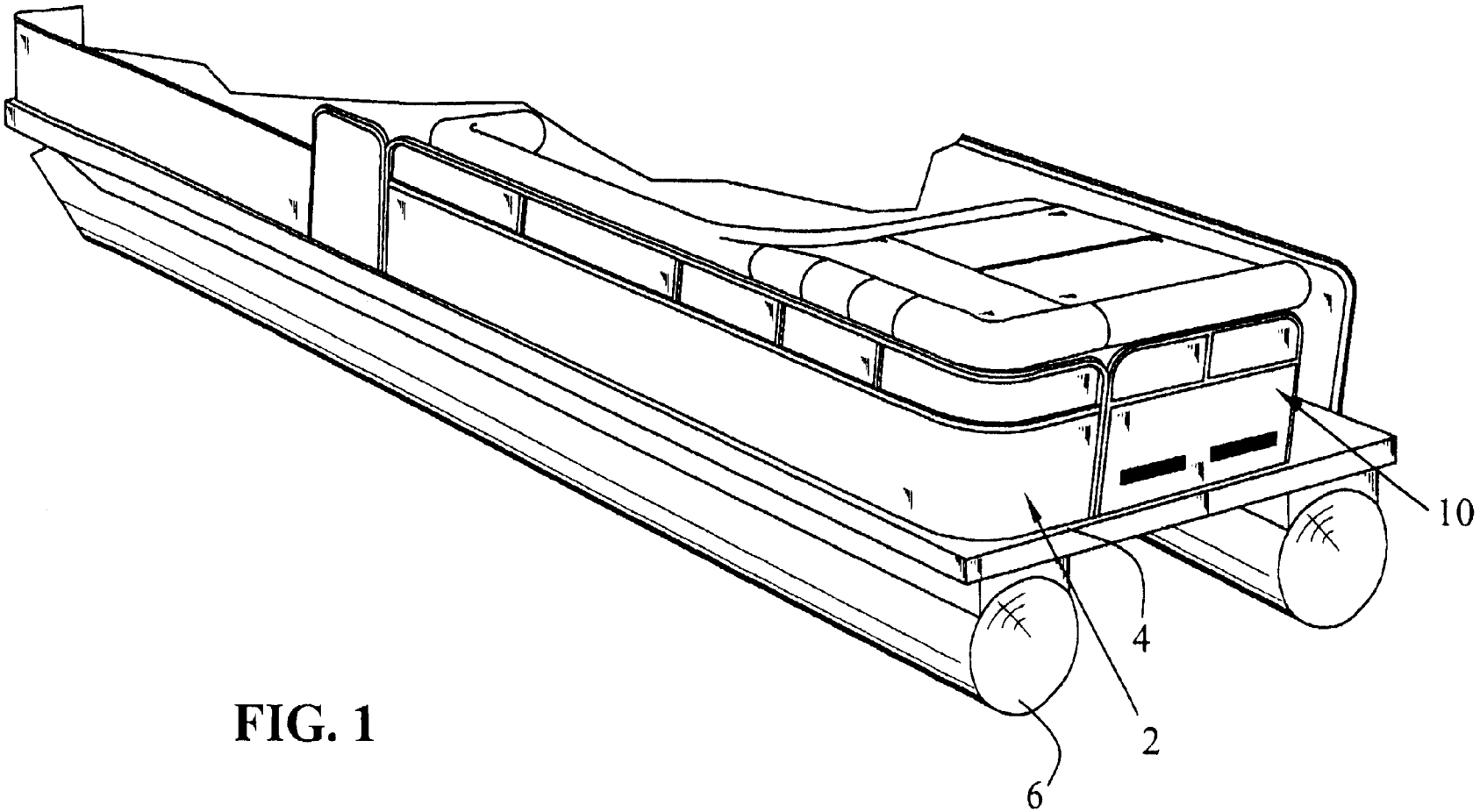
FIG. 1 is a rear perspective view of the pontoon boat, partially fragmented, according to the preferred embodiment of the invention.

Referring first to FIG. 1, a pontoon boat according to the present invention is shown at 2, which generally includes a deck at 4 having a plurality of pontoons 6 attached beneath the deck 4 for flotation of the pontoon boat, and the pontoon boat 2 further comprising a combination engine compartment and privacy enclosure shown generally at 10.

Figure 3:
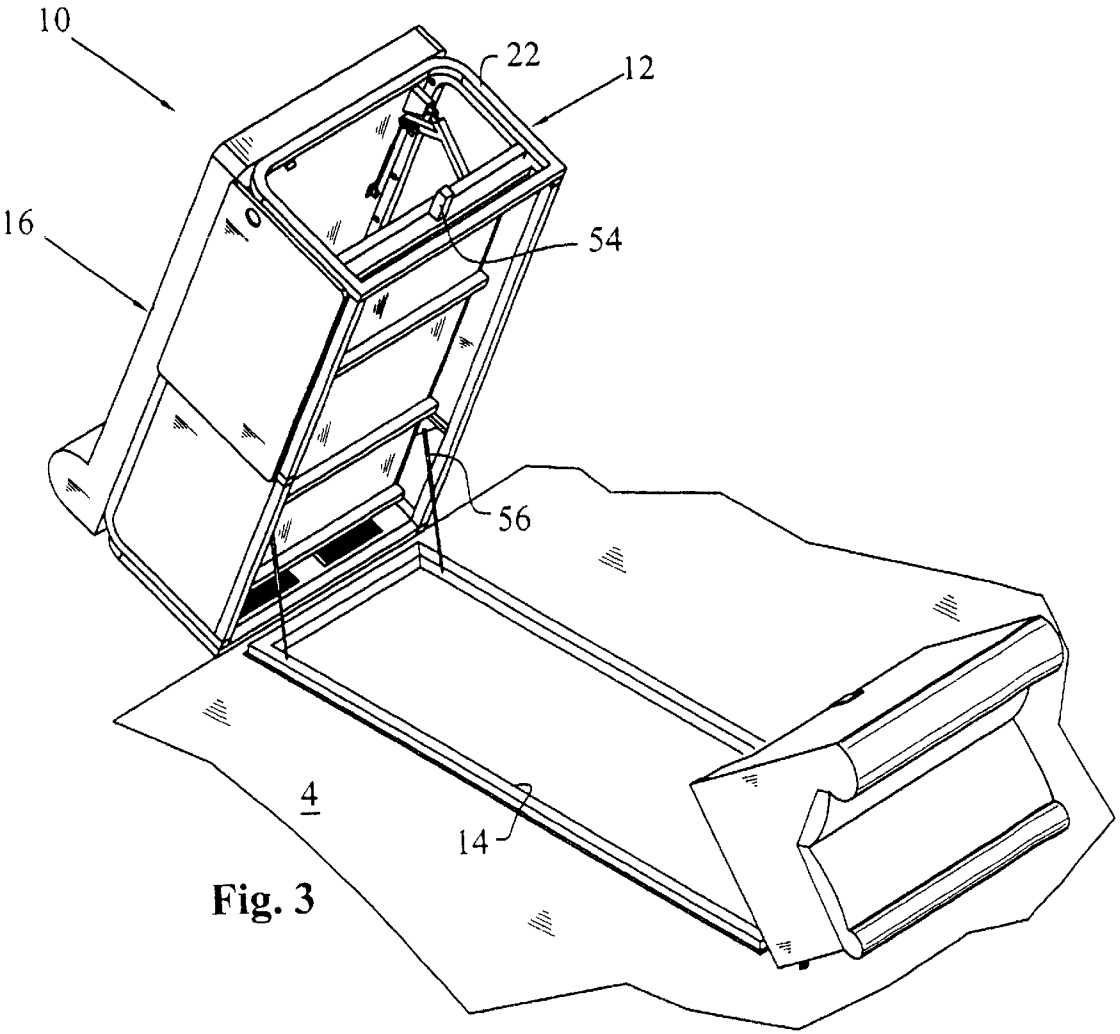
FIG. 3 is a view similar to that of FIG. 2, showing the enclosure rotated open to view the engine compartment opening through the pontoon deck.
Figure 6:
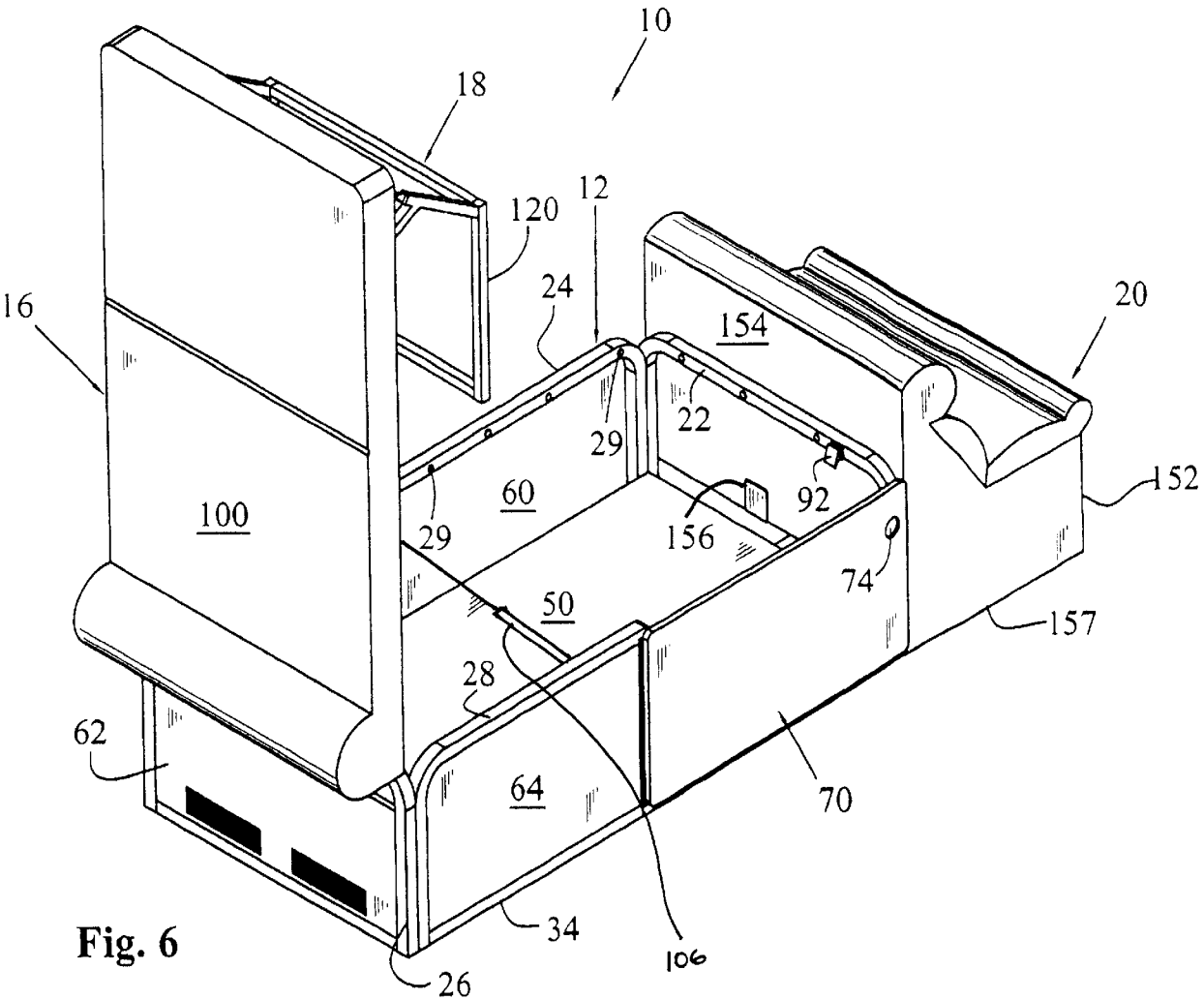
FIG. 6 is a view similar to that of FIG. 5, showing the top cover rotated to a fully open position.

As best shown in FIGS. 3 and 6, the combination engine compartment cover and privacy enclosure 10 generally comprise a rotatable frame member 12, which overlies an opening 14 through deck 4, and which includes a top pivotable cover member shown best in FIG. 6 as reference numeral 16. Also shown best in FIG. 6, a privacy enclosure structure is shown generally at 18 and will be described in greater detail herein. As shown in either of FIG. 3 or 6, a rotatable seat is also shown at 20, which is preferably also pivotable relative to deck member 4 and which abuts a front edge of the combination engine compartment cover and privacy enclosure 10.

Figure 7:
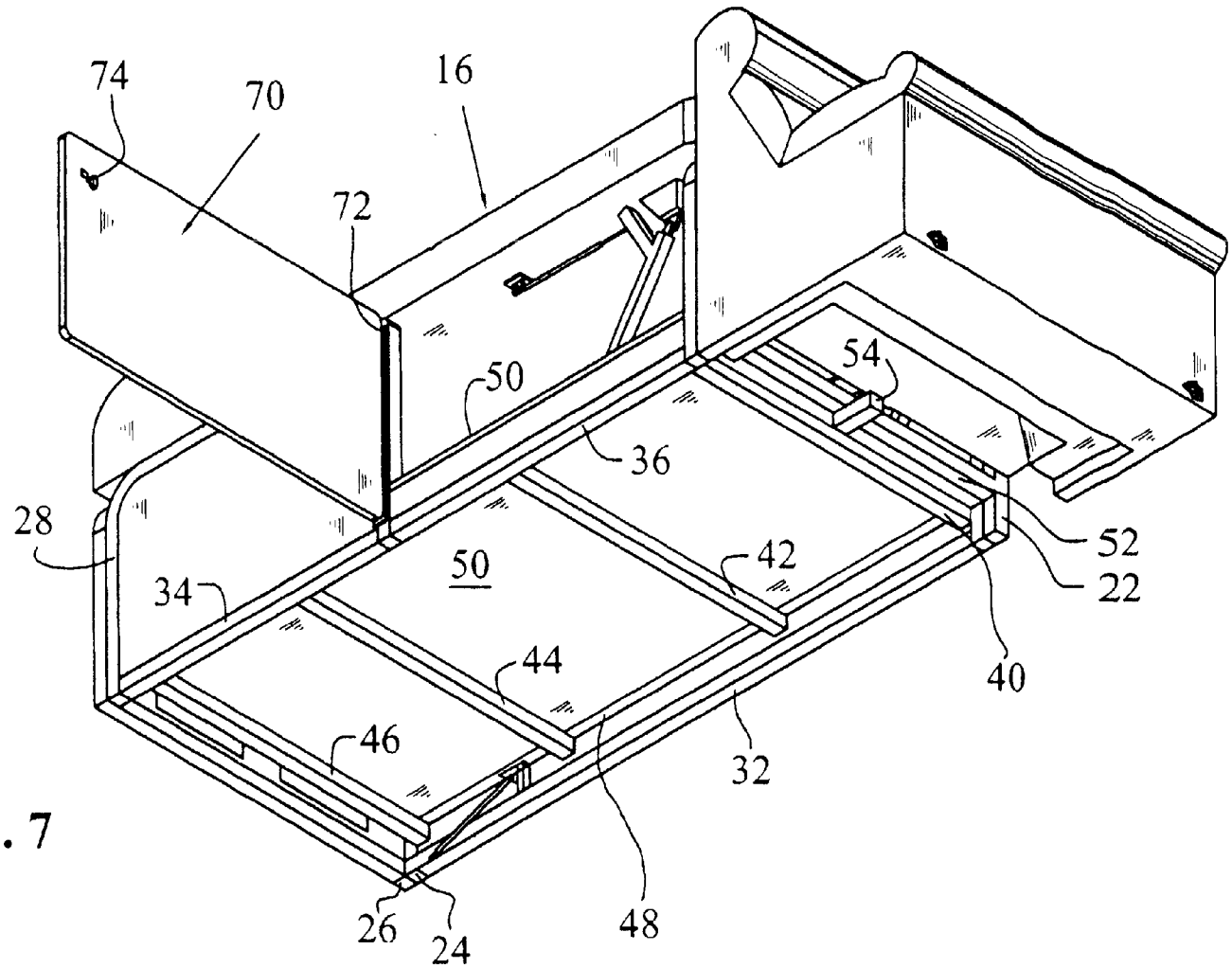
FIG. 7 is a lower perspective view of the combination according to any of the FIGS. 2 through 6.

With reference now to FIGS. 3 through 7, frame member 12 will be described in greater detail. With reference to FIGS. 3 and 6, frame member 12 includes a plurality of U-shaped channel members, for example, front channel member 22, side channel member 24, rear channel member 26, and right-side channel member 28. As best shown in FIG. 7, rigidifying posts are positioned intermediate the U-shaped frame members, for example, post 32 is shown extending between individual legs of U-shaped frame member 24, post 34 is shown extending between legs of U-shaped frame member 28, and post 36 is shown extending between legs of U-shaped frame members 28 and 22. With reference still to FIG. 7, a subframe is shown for a raised floor, including a plurality of horizontally and transversely extending support posts 40, 42, 44, and 46, which are attached to longitudinally extending posts 48 (only one of which can be viewed in FIG. 7). The horizontally extending posts 40–48 support a raised floor member 50.

Furthermore, the enclosure 10 includes side panel members 60 covering U-shaped member 24, end panel member 62 covering U-shaped member 26, and side panel member 64 covering U-shaped channel member 28. An access door 70 is hingedly mounted at 72 to an edge of channel member 28 as shown best in FIG. 7 and is movable between a closed position shown in FIG. 6 and an open position shown in FIG. 7 to access the raised floor 50. It should be appreciated that a latch structure such as 74 is included to latch the door in a fully closed position, and it should be appreciated by those skilled in the art.

Figure 4:
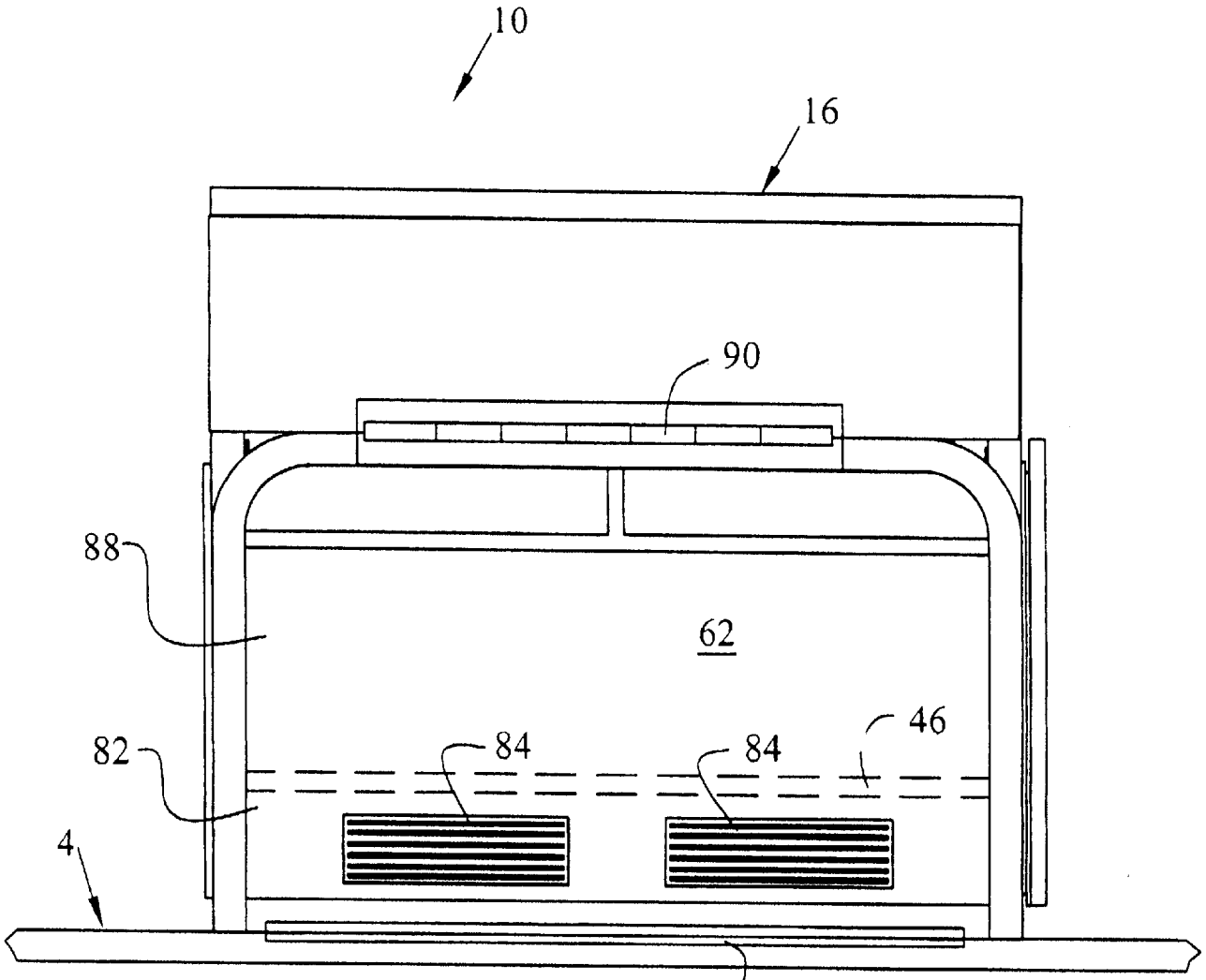
FIG. 4 is a rear perspective view of the combination engine compartment cover and privacy enclosure shown in FIGS. 1 and 2.

With respect now to FIGS. 3 and 4, the enclosure 10 is shown mounted in a position substantially covering the engine compartment opening 14, where the enclosure 10 is pivotally mounted by way of hinge 80, which is along the rear edge of enclosure 10, which also happens to correspond with the rear edge of the pontoon boat 2. As also shown in FIG. 4, the area below horizontal posts 40–46 forms a compartment area 82, which can cover any of the engine components which extend or upstand higher than deck member 4. This can include air intake hoses (not shown) which are attached to either or both of air vents at 84 which extend through end wall 62. With reference still to FIG. 4, the area above horizontal posts 40–46, and more particularly above floor 50, forms a compartment area 88, which will be used as a privacy compartment as described further herein.

With reference still to FIG. 4, top cover member 16 is pivotally mounted to frame member 12 by way of a hinge at 90, allowing pivotal movement of the top cover relative to the frame between the closed position shown in FIG. 4, and a fully opened position shown in FIG. 6. As also shown in FIG. 6, a latch member 92 is shown attached to U-shaped channel member 22 and positioned adjacent to door 70 to latch and unlatch top cover 16 in a locked condition. As also shown in FIG. 6, top cover portion 16 includes an outer padded portion 100, and an inner structural planar portion, for example, such as a planar wood board section 102. FIG. 6 also shows air assist struts 106 positioned between planar portion 102, and an inside edge of U-shaped frame members 24, 28 to hold the cover member 16 in a fully upright position.

Figure 8:
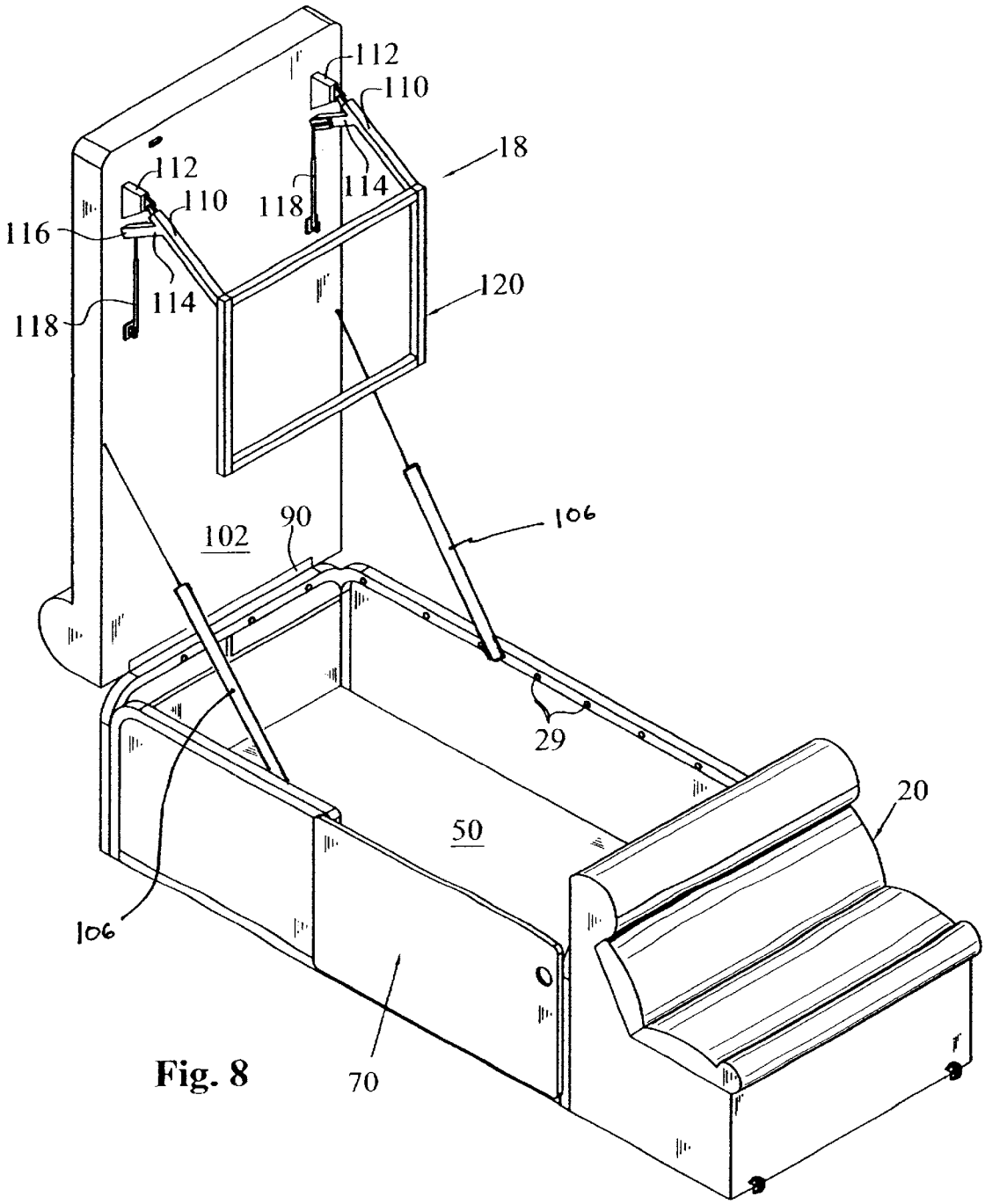
FIG. 8 is a top perspective view of the combination shown in any of the previous figures, showing the top cover rotated open, and showing the privacy curtain removed for clarity of the support structure.
Figure 11:
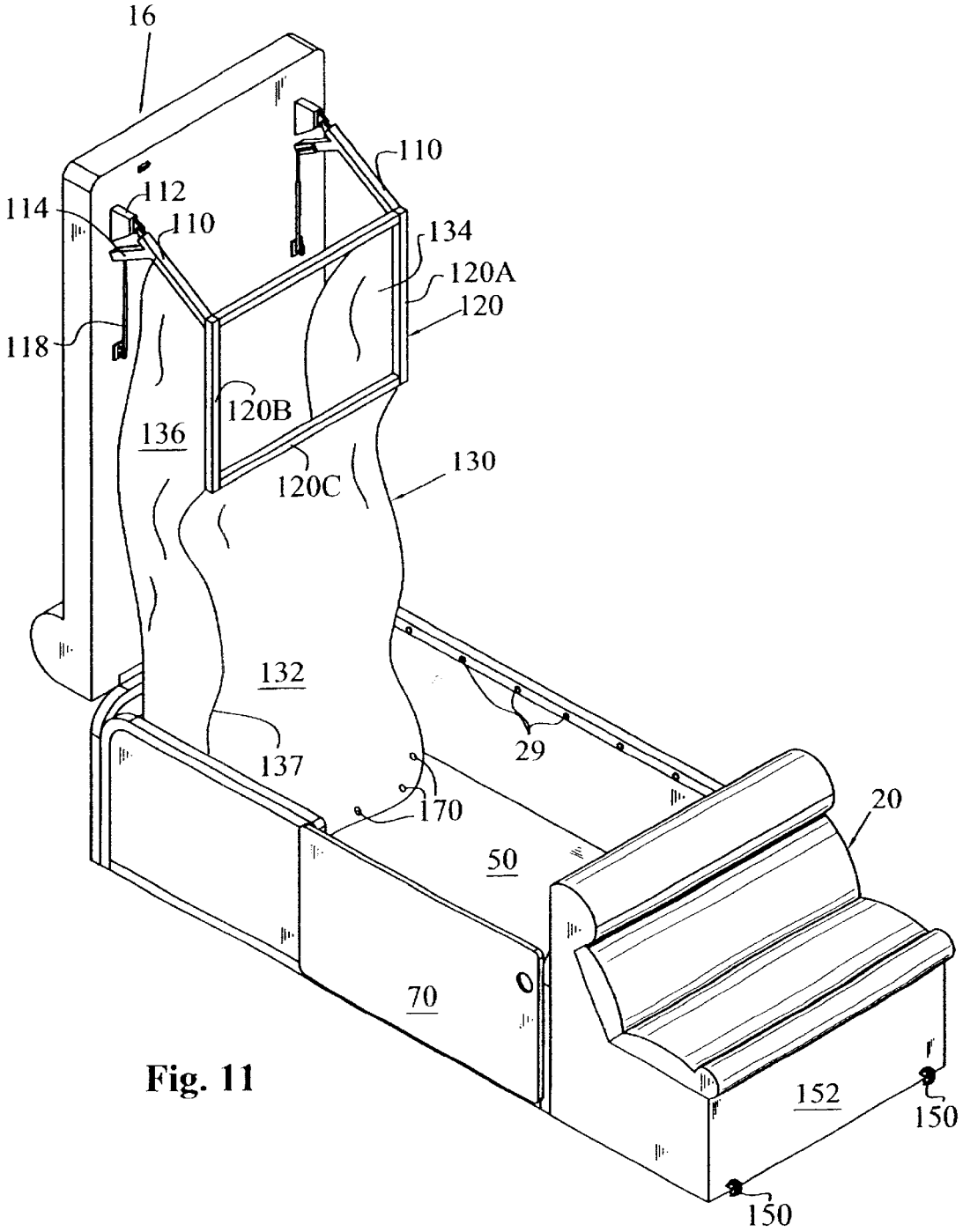
FIG. 11 is a perspective view similar to that of FIG. 8, showing the privacy curtain attached.

With reference now to FIG. 8, the support structure 18 for the privacy enclosure will now be described in greater detail. The support structure 18 includes Y-shaped legs 110 attached to pivot mount sections 112, where Y-shaped legs 110 include sections 114 having remote free ends 116 attached to gas assisted shocks 118. Gas assisted shocks are attached to an inside surface of legs 114 and further include an opposite end connected to planar portion 102. Legs 110 further comprise a rectangular privacy curtain support member 120, which as shown in FIG. 8, is shown in the stowed position. As shown in FIG. 11, a privacy curtain 130 is shown having a front section 132 and side sections 134 and 136.

With respect still to FIG. 11, lounge chair 20 is pivotally connected to the deck 4 by way of pivot mounts 150 attached to a front edge 152 of lounge chair 20. With respect to FIG. 6, a rear side 154 of lounge chair 20 includes a rigidifying plate at 156 as will be described in greater detail. As shown in FIG. 6, when chair is in the fully closed position, the chair partially covers the engine compartment opening 14, and abuts U-shaped frame member 22. Having described the various components, the assembly and operation of the enclosure 10 will now be described in greater detail.

With reference first to FIGS. 6 and 7, the enclosure 10 should be manufactured as mentioned above with the various frame members, such as U-shaped frame members 22, 24, 26, and 28, to be held in a jig or other fixture, whereupon posts 32, 34, 36 can be positioned intermediate the legs of the U-shaped channels as mentioned before. These various items can then be fixed together, such as by welding or other known means, such as brackets or suitable fasteners. The raised floor assembly will then be provided including the transverse cross members 40–46, whereupon floor 50 can be positioned within the enclosure. As floor 50 will be visible to the user in the privacy enclosure, more than likely the top surface of floor 50 includes a finished surface, such as carpeting or other suitable surface.

Snap members 29 are also positioned on the inside surfaces of the various U-shaped channels 22, 24 and 28 as best shown in FIG. 6. The panel members 60, 62 and 64 are also positioned about respective U-shaped channels 24, 26, 28, and door 70 is hingedly fixed to U-shaped channel 28.

As mentioned above, top cover portion 16 includes both a rigid portion 102, as shown in FIG. 8, with an outer covering 100, which would normally include both padding as well as a top covering such as a vinyl or leather for aesthetic purposes. With the top cover 16 as described, this unit can be hingedly attached to the frame member, hinge 90 as shown in FIG. 8. The privacy support portion 18 can either be preassembled to the top cover or assembled to the top cover once attached to the frame member, in any event, the privacy support 18 would be attached as shown in FIG. 8, such that arms 110 pivot about their pivot points 112 with gas assisted shocks 118 attached to an inside surface of leg portions 114. Curtain 130 would then be fixed to the rectangular portion 120 with side portions 134 and 136 attached to the legs 120A and 120B, respectively, and with front curtain portion 132 attached to the front leg 120C. The privacy curtain 130 can be attached in a variety of ways as known in the art, to include snap members, industrial sewing, or hanging clips, which attach to member 120.

As described above, this unit is now positioned at the edge of the pontoon boat over opening 14 which allows access to an inboard-outboard engine, and is hingedly attached as shown by hinge 80 in FIG. 4. The gas assisted shocks 56 (FIG. 3) are also positioned and are now interconnected between the frame member 12 and a position adjacent the deck as described more fully herein. As mentioned above, in the preferred embodiment of the invention, an engine would include intake hoses routed to the air intake manifold of the engine, and would be connected to one or both vents 84 at the rear of the enclosure 10. Rotatable seat 20 is also fixed to the deck 4 by way of pivot connections or hinges 150. With the enclosure 10 assembled to the pontoon boat as described above, the operation of the enclosure 10 will now be described in greater detail.

Figure 2:
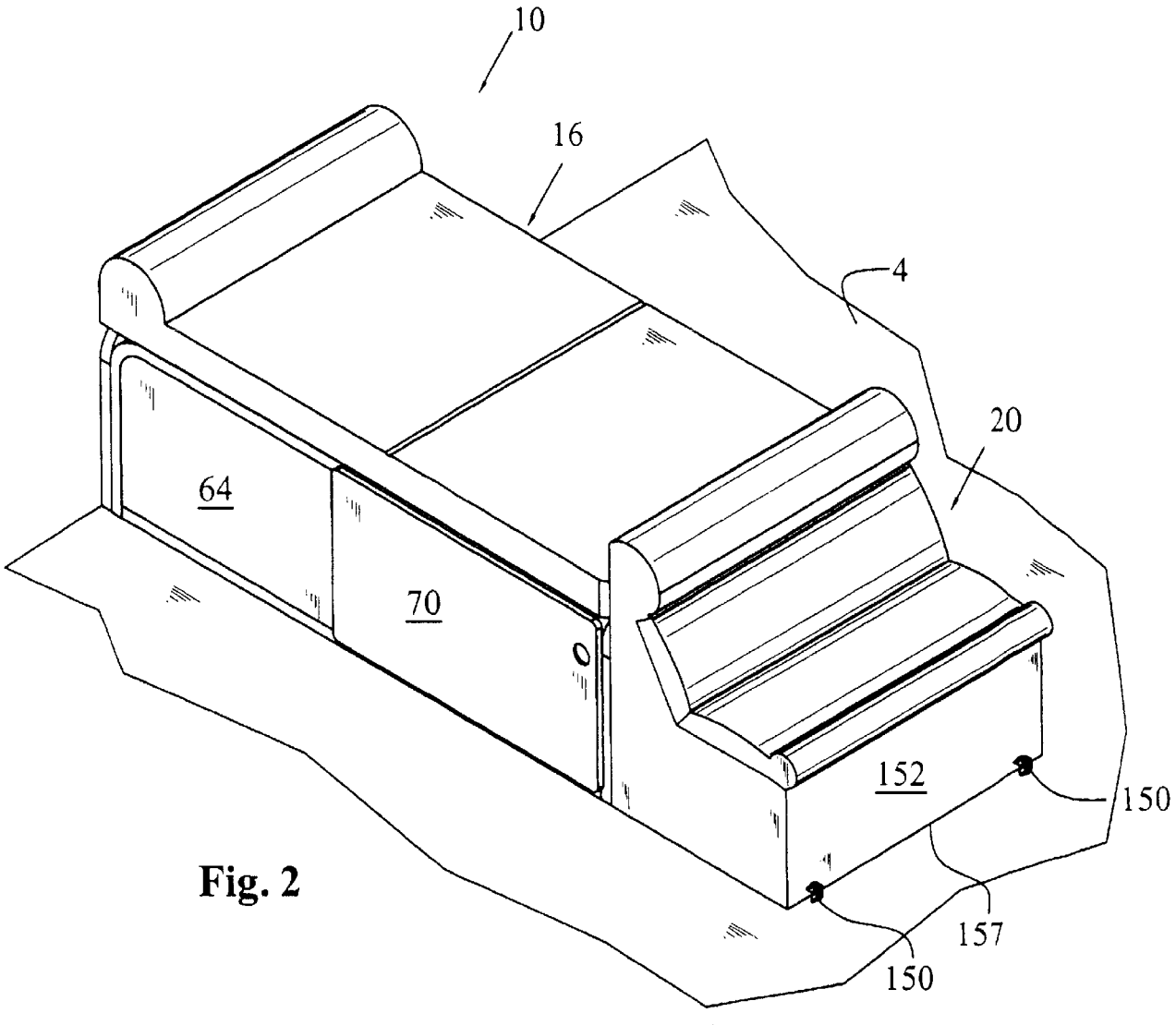
FIG. 2 is a top perspective view of the combination engine compartment cover and privacy enclosure.
Figure 5:
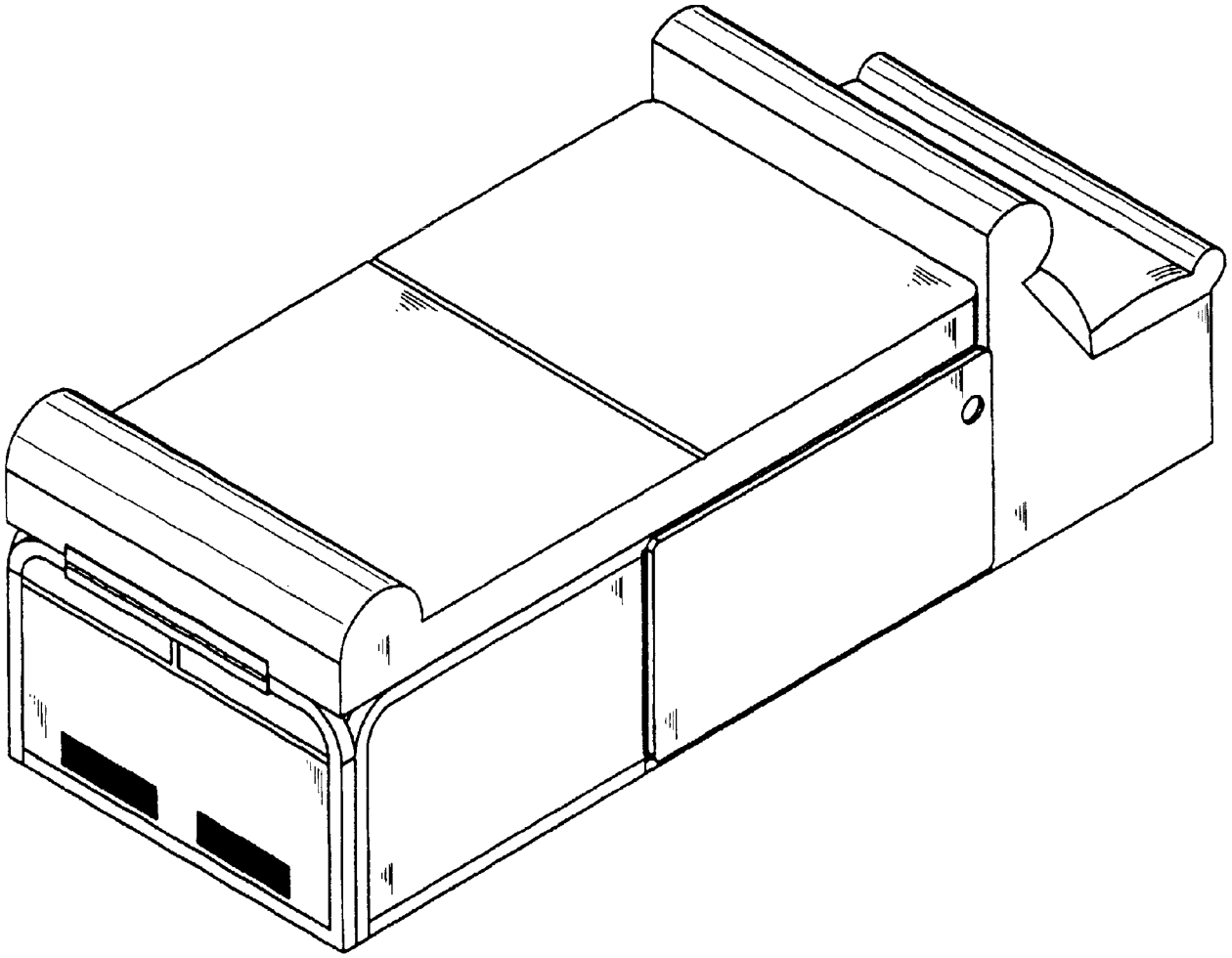
FIG. 5 is a rear perspective view of the combination shown in any of the FIGS. 2 through 4.
Figure 12:
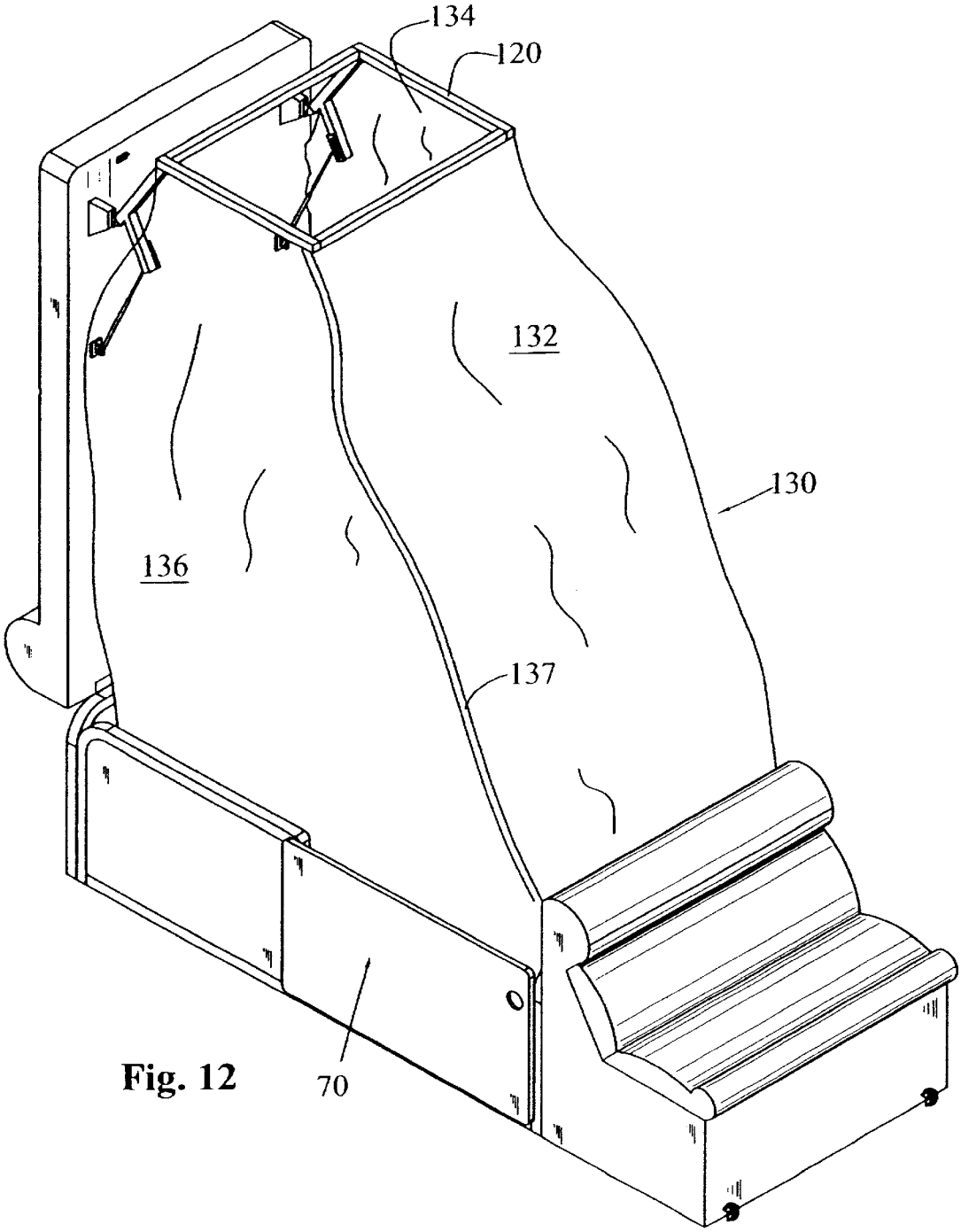
FIG. 12 is a perspective view similar to that of FIG. 11, showing the privacy curtain support arms rotated in the fully upward position and with the curtain shown in the completed position.

It should be apparent from the description above that the enclosure 10 has three modes of operation, including a normally closed mode as shown in either of FIG. 2 or 5, a mode allowing access to the engine compartment as shown in FIG. 3, and in a mode to act as a privacy enclosure as shown in FIG. 12.

It should be apparent that, when in the normal operation as shown in FIG. 2 or 5, the enclosure 10 is rotated to a closed position, with lounge chair 20 also rotated into the opposite sense. It should be appreciated that the gas assisted shocks 56 are provided with such a spring force that when the enclosure 10 is rotated to a fully closed position, the moment caused by the weight of the enclosure through the pivot point of hinge 80 prevents the enclosure 10 from rotating about hinge 80. However, chair 20 also overlaps enclosure 12 by way of rigidifying plate 156 (FIG. 6) on the back of lounge chair 20, which overlies peg 54 (FIG. 3) when in the fully rotated position.

If the enclosure in its entirety is to be lifted, that is, to access the engine compartment 14, chair 20 is first rotated in a clockwise sense to a position shown in FIG. 3. The enclosure 10 may now be rotated about hinge 80 in a counter-clockwise sense, as viewed in FIG. 3, and when the enclosure 10 is rotated to a fully upright position, the gas assisted shocks will hold the enclosure open, due to the change in the weight transfer about hinge 80, as well as the change in the location of the pivot point of gas assisted shocks 56 relative to the frame as is known to those skilled in the art. Thus, the enclosure 10 has a second mode of operation shown in FIG. 3 in a fully upright position, where the inboard-outboard engine can be accessed or serviced.

Figure 9:
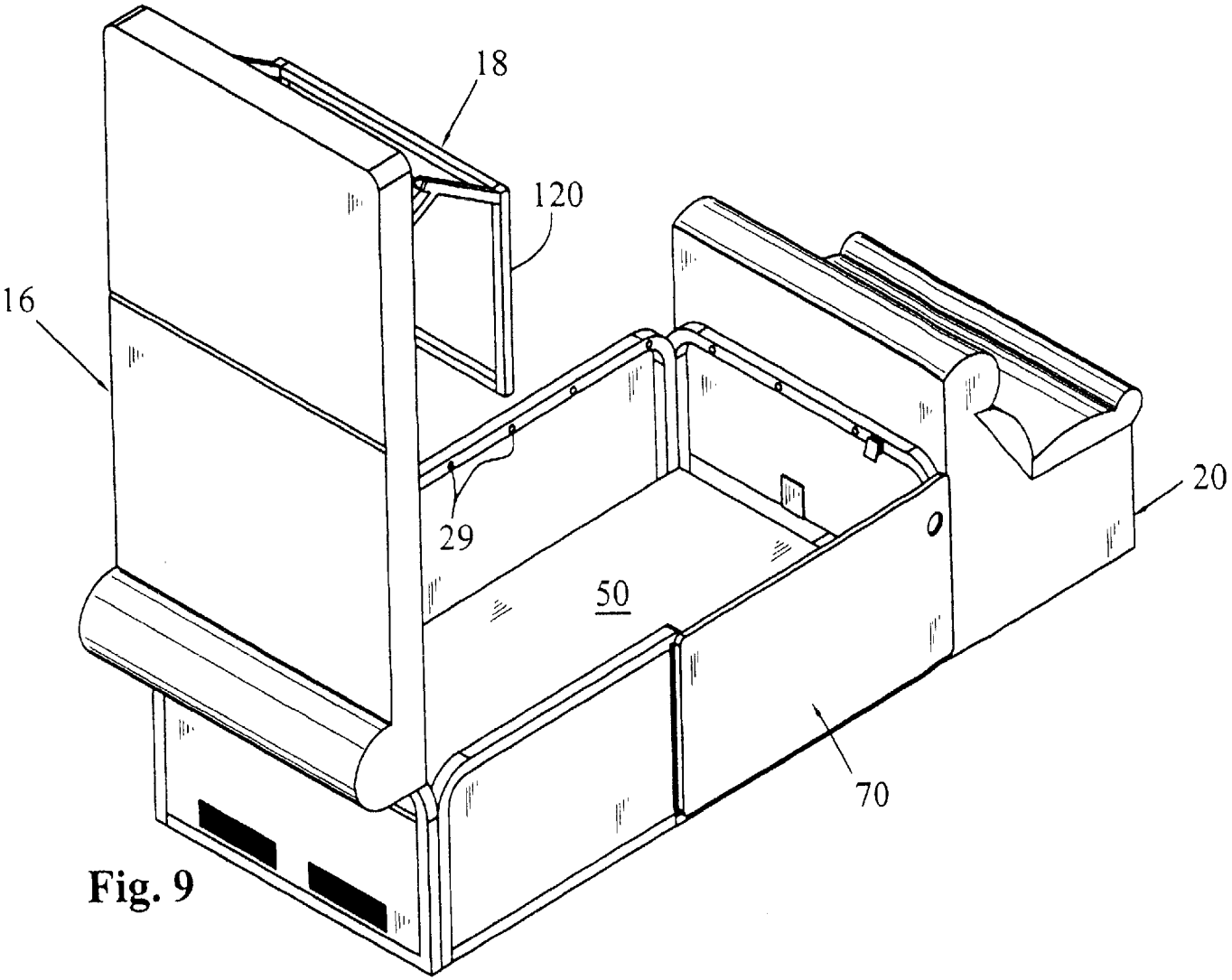
FIG. 9 is a rear perspective view similar to that of FIG. 8, showing the privacy support arms rotated in the fully rotated upward position.
Figure 10:
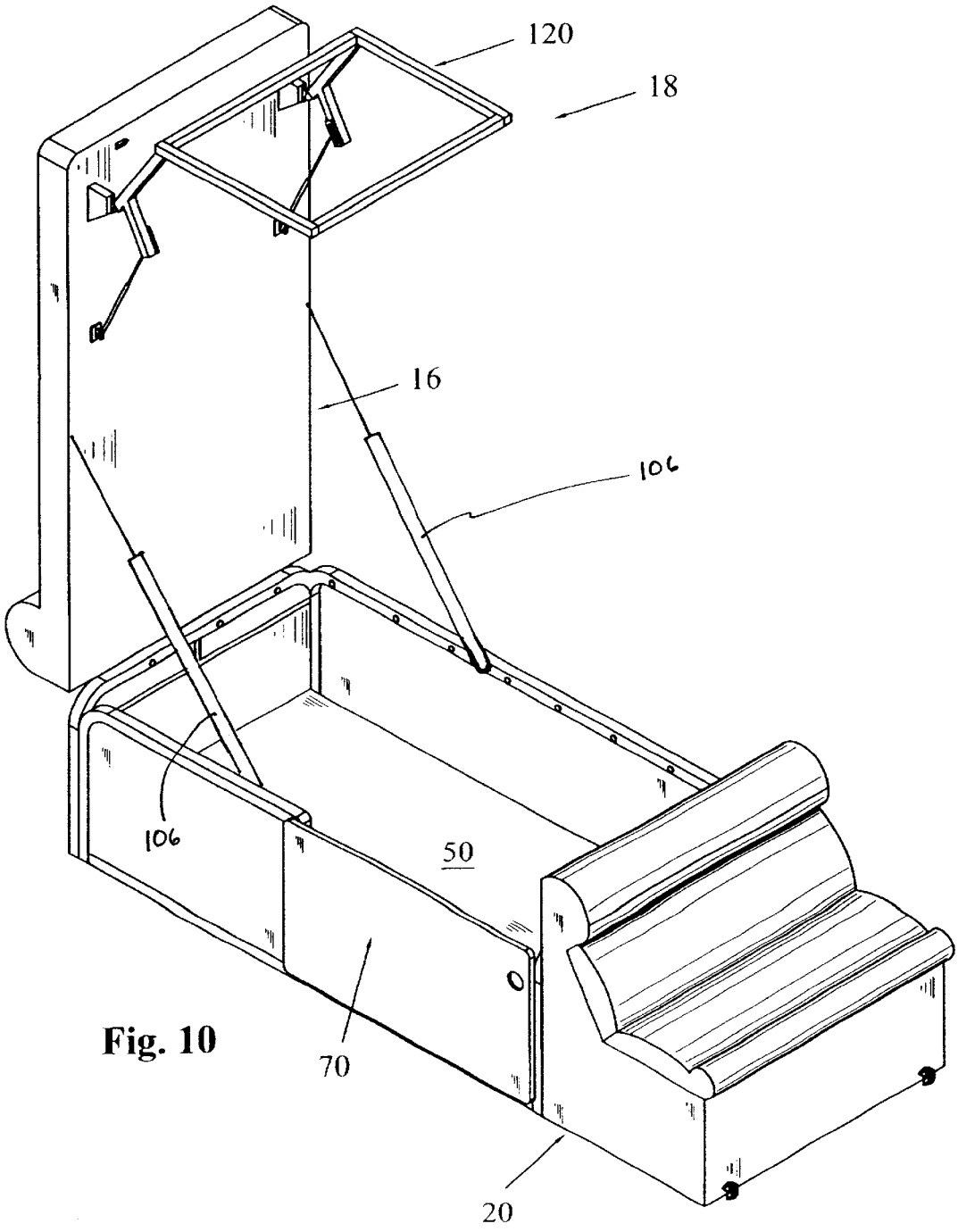
FIG. 10 is a perspective view similar to that of FIG. 9.

When the privacy enclosure is desired for use, the user can open door 70 by way of latch 74 and access latch member 92. This allows the opening of top cover member 16 to be held open by gas assist struts 106 in the position shown in FIG. 11. When in the position of FIG. 11, the curtain support 120, together with arms 110, may be rotated in the counter-clockwise sense as viewed in FIG. 11 (to a position consistent with FIG. 9 or 10), whereupon gas assisted shocks 118 will hold the support 120 upwardly. This is due to the design of the support arms in a Y-shape arrangement. Said differently, when in the position of FIG. 11, the gas assisted shock 118 has its spring force assisting holding the support 120 in a stowed position, due to the moment created by gas assisted shocks 118 through arms 114 in relation to its pivot point 112. However, when the support 120 is rotated to the position consistent with either of FIG. 9 or 10, gas assisted shocks now have their spring force acting in a moment which holds the support 120 in a fully upward position as should be apparent from FIG. 10.

To complete the enclosure, the various snaps 170 at the bottom of the curtain 130 are snapped with corresponding snaps 29 on the inside of the enclosure, whereby the curtain 130 takes on a substantially truncated pyramidal shape, as shown best in FIG. 12. It should be appreciated also that the zipper 130 would have its clasp adjacent to door 70, such that the zipper opens as the clasp is raised upwardly towards support member 120, such that the user can open door 70 and move curtain side wall 136 sideways and enter the privacy enclosure. It should be appreciated that the disassembly of the privacy enclosure includes a reverse process, where snaps 170, 29 are released, support member 120 is rotated back to the position shown in FIG. 11, and the top cover 16 is rotated in the clockwise position to a fully closed position.

It should be appreciated that applicants have devised a very versatile and easily manipulated enclosure for operating as both an access for an inboard-outboard engine of a pontoon boat, as well as provide it for a privacy enclosure.

What is claimed is:

1. A pontoon boat, comprising:

a hull portion comprising a deck portion, a plurality of elongate pontoons positioned below said deck portion, said hull portion further comprising an engine compartment positioned adjacent an end of said of said hull portion, and at least partially below said deck portion, defining an engine compartment opening through said deck portion;

an inboard-outboard engine positioned within said engine compartment with a drive portion extending outwardly and rearwardly of said hull portion for propelling said pontoon boat;

an engine compartment cover assembly which substantially surrounds said engine compartment opening, said engine compartment cover assembly being pivotally mounted to said pontoon boat at a position adjacent to an edge of said engine compartment, said engine compartment cover assembly comprising upstanding side walls and end walls, said end walls and side walls defining a frame member which surrounds said engine compartment, said engine compartment cover assembly further comprising a raised floor section attached to said frame member, and a top cover portion which is pivotally mounted to said frame member, said top cover portion having a privacy enclosure assembly attached to an underside thereof, movable between stowed and upright positions and which includes a privacy curtain which drapes downwardly in the upright position to define said privacy enclosure.

2. A pontoon boat according to claim 1, wherein said frame member includes a door allowing entry therethrough and access to said raised floor.

3. A pontoon boat according to claim 2, wherein said privacy enclosure assembly includes a curtain frame which is pivotally mounted to said top cover portion.

4. A pontoon boat according to claim 3, wherein said engine compartment cover assembly and said top cover portion are pivotally movable about horizontal and parallel axes.

5. A pontoon boat according to claim 4, wherein said top cover portion has a locking latch for lockably latching said top cover portion to said frame member.

6. A pontoon boat according to claim 5, wherein said frame member has first spring means for holding said frame member in an upright position.

7. A pontoon boat according to claim 6 wherein said first spring means is comprised of gas assisted shocks.

8. A pontoon boat according to claim 5, wherein said top cover portion has second spring means to hold said top cover portion in an upright position.

9. A pontoon boat according to claim 8, wherein said second spring means is comprised of gas assisted shocks.

10. A pontoon boat according to claim 5, wherein said curtain frame has third spring means to hold said curtain frame in an upright position.

11. A pontoon boat according to claim 10, wherein said third spring means is comprised of gas assisted shocks.

12. A pontoon boat according to claim 1, wherein a front one of said end walls is open.

13. A pontoon boat according to claim 12, further comprising a lounge seat pivotally mounted to said deck portion from a front edge thereof, and which partially overlies said engine compartment opening, whereby when said lounge seat and said engine compartment cover assembly are positioned against said deck, said lounge seat and said engine compartment cover assembly abut to enclose said engine compartment, and whereby when said lounge seat and said engine compartment cover assembly are pivoted open said engine compartment is accessible.

14. A pontoon boat according to claim 1, wherein said lower edges of said privacy curtain is attachable to said end walls and side walls to define said privacy enclosure.

15. A combination engine compartment cover and privacy enclosure assembly, for positioning over an engine compartment of marine craft, where the engine compartment defines an opening through the deck of the marine craft for access to an engine, the assembly comprising:

a frame member comprised of side walls and end walls which upstand to at least partially surround the opening, said frame member being pivotally connectable to the deck of the marine craft, for pivotal movement between a first closed position where said frame member abuts the deck, and a pivotally raised position with the opening accessible;

a raised floor member attached to said frame member and extending substantially between said end walls and side walls;

a top cover member pivotally attached to said frame member at an upper edge of one of said end or side walls; and a privacy enclosure assembly attached to an underside thereof, movable between stowed and upright positions and which includes a privacy curtain which drapes downwardly in the upright position to define said privacy enclosure.

16. A combination assembly according to claim 15, wherein said frame member includes a door allowing entry therethrough and access to said raised floor.

17. A combination assembly according to claim 15, wherein said privacy enclosure assembly comprises support arms pivotally attached to an underside of said top cover.

18. A combination assembly of claim 17, wherein said top cover is pivotal to a position substantially vertical.

19. A combination assembly of claim 18, wherein said support arms are pivotal to positions substantially vertical.

20. A combination assembly of claim 19, wherein said privacy enclosure assembly further comprises a privacy curtain support member attached to ends of said support arm, opposite said pivoted ends.

21. A combination assembly of claim 20, wherein said top cover pivots about a rear edge thereof, and said support arms pivot about a position adjacent a front edge of said top cover, whereby when said top cover and said support arms are pivoted into the open position, said privacy curtain support member is raised above said deck to a height substantially equal to the additive length of said top cover and said support arms.

22. A combination assembly of claim 20, wherein said privacy curtain attaches to said end walls and said side walls to define said privacy enclosure.

23. A combination assembly of claim 22, wherein said privacy curtain support member is rectangular, and said privacy curtain, when attached to said end walls and said side walls, defines a substantially truncated pyramidal shape.

24. A combination assembly of claim 22, wherein said privacy curtain attaches to said end walls and said side walls by way of snap members.

25. A combination assembly according to claim 15, wherein a front one of said end walls is open.

26. A combination assembly according to claim 25, further comprising a lounge seat for pivotally mounting to the deck portion from a front edge thereof, and for partially overlying the engine compartment opening, whereby when said lounge seat and combination engine compartment cover and privacy enclosure assembly are positioned against the deck, said lounge seat and said engine compartment cover assembly abut to enclose said engine compartment, and whereby when said lounge seat and said engine compartment cover assembly are pivoted open the engine compartment is accessible.

* * * * *